US005249970A

United States Patent [19]

Jennings

[11] Patent Number: 5,249,970

[45] Date of Patent: Oct. 5, 1993

[54] MULTIPLE POSITION ELECTRICAL SWIVEL PLUG APPARATUS

[76] Inventor: Michael P. Jennings, R.F.D. #1, Box 20, South Ryegate, Vt. 05069

[21] Appl. No.: 970,838

[22] Filed: Nov. 3, 1992

Related U.S. Application Data

[63] Continuation-in-part of Ser. No. 795,727, Nov. 21, 1991, abandoned.

[51] Int. Cl.[5] ..... H01R 39/64

[52] U.S. Cl. ..... 439/31; 439/11; 439/638; 439/655

[58] Field of Search ..... 439/8, 10, 11, 31, 638, 439/655; 403/96

[56] References Cited

U.S. PATENT DOCUMENTS

| | | | |
|---|---|---|---|
| 1,873,042 | 8/1932 | Rohrdanz | 439/18 |
| 2,305,100 | 12/1942 | O'Brien | 439/31 |
| 2,305,101 | 12/1942 | O'Brien | 439/31 |
| 2,447,026 | 8/1948 | O'Brien | 439/31 |
| 3,355,695 | 11/1957 | Overesch | 439/31 |
| 3,860,312 | 1/1975 | Gordon, Jr. | 439/31 |
| 4,643,508 | 2/1987 | Schaller | 439/31 |

FOREIGN PATENT DOCUMENTS

| | | | |
|---|---|---|---|
| 292769 | 11/1989 | Japan | 439/31 |

*Primary Examiner*—Mark Rosenbaum
*Assistant Examiner*—Peter Dungba Vo
*Attorney, Agent, or Firm*—Brady, O'Boyle & Gates

[57] ABSTRACT

A multiple position electrical swivel plug apparatus wherein a housing is integrally connected to the end of an electrical cord the conductor of which terminates in a plurality of blades. A male or female plug assembly is detachably connected to the blades depending upon the particular plug assembly desired. The blades are mounted in the housing which is bifurcated so that the blades extend outwardly from the housing between the arms of the housing. The plug assembly has a nose portion extending between the arms of the housing, and the nose portion is slotted for receiving the blades to electrically connect the plug assembly contacts to the blades. A pivotal connection is provided between the arms of the housing and nose portion of the plug assembly for adjusting and maintaining the plug assembly at a desired angle position relative to the housing.

5 Claims, 4 Drawing Sheets

FIG. 2
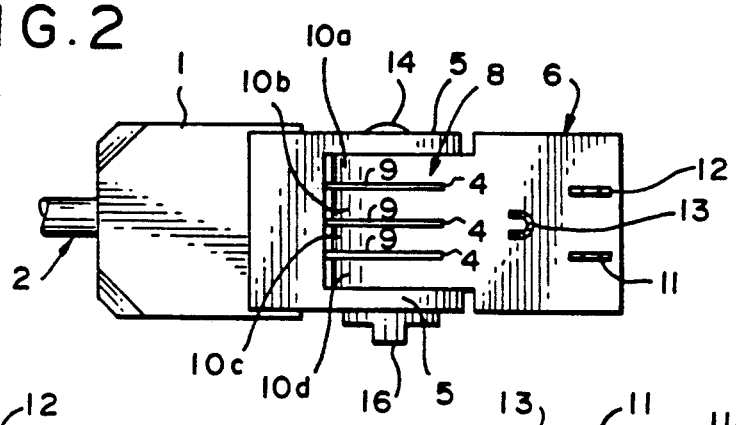
FIG. 1
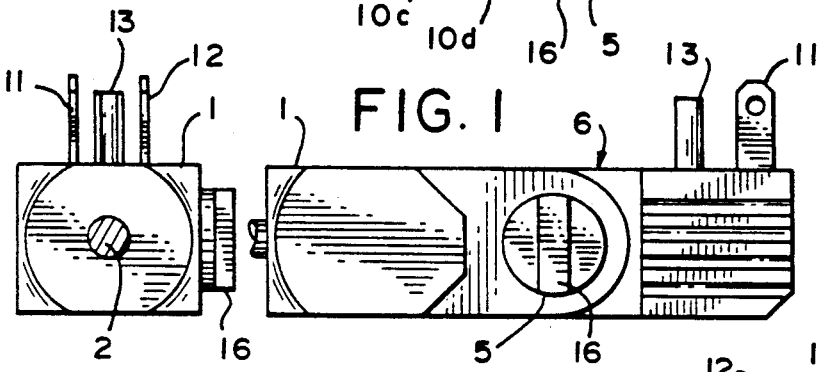
FIG. 4
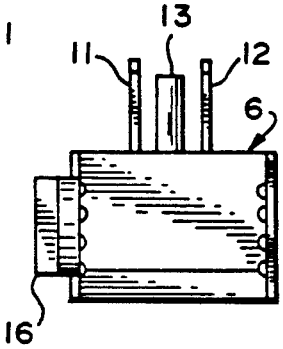
FIG. 5
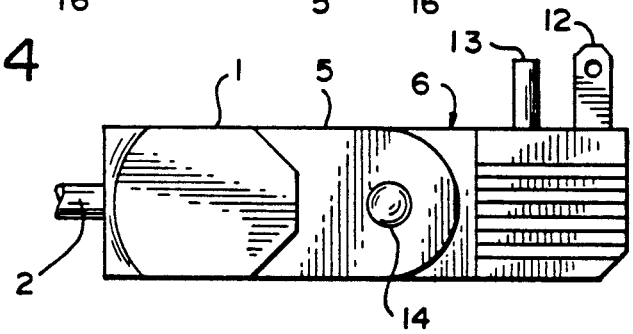
FIG. 3

FIG. 7
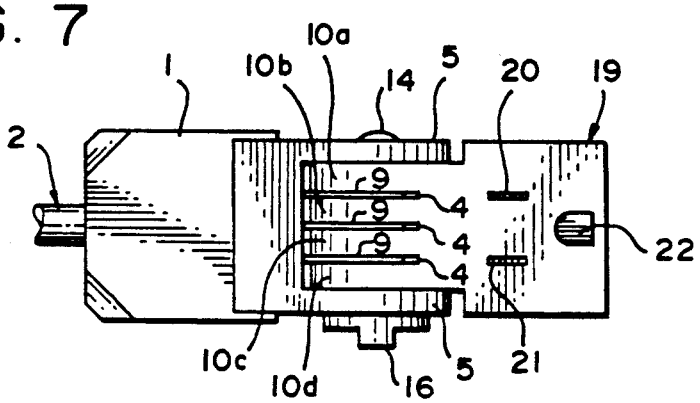
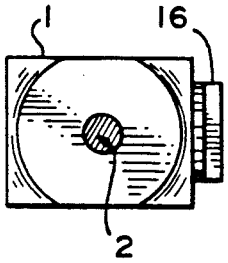
FIG. 9
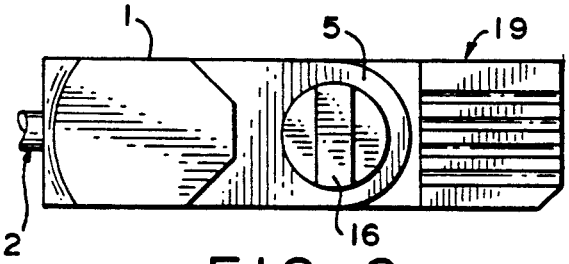
FIG. 6
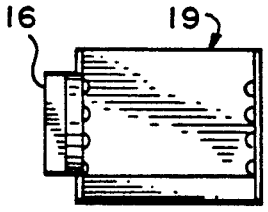
FIG. 10
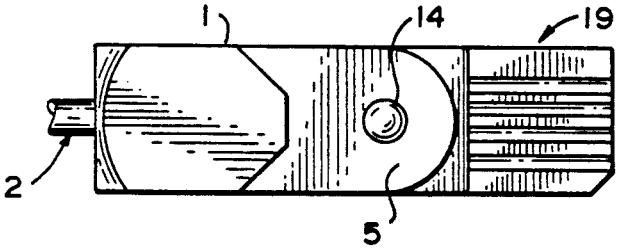
FIG. 8

MULTIPLE POSITION ELECTRICAL SWIVEL PLUG APPARATUS

CROSS-REFERENCE TO RELATED PATENT APPLICATION

This application is a continuation-in-part of application Ser. No. 07/795,727, filed Nov. 21, 1991, now abandoned.

BACKGROUND OF THE INVENTION

The concept of providing an electrical cord with a swivel plug assembly is disclosed in U.S. Pat. No. 2,305,101 and Japanese Patent 292,769, dated November 1989. While these swivel plug assemblies have been satisfactory for their intended purpose, they have been limited to particular uses; that is, they are limited to use with the electrical cord of an appliance and are not lockable in a desired pivoted position.

SUMMARY OF THE INVENTION

After considerable research and experimentation, the multiple position electrical swivel plug apparatus of the present invention has been devised which comprises, essentially, a bifurcated housing integrally mounted on the end of an electrical cord. The conductor of the cord terminates in a plurality of parallel, transversely spaced blades positioned between the arms of the bifurcated housing. The plug assembly comprises a body having a nose portion insertable between the arms of the bifurcated housing, the nose portion being slotted to provide a plurality of parallel, transversely spaced fingers, the blades of the housing being insertable into the spaces between the fingers to thereby be in electrical contact with the conductors in the plug assembly. A lock pin assembly secures the nose portion of the plug assembly between the arms of the bifurcated housing, whereby the plug assembly can be pivoted to a desired position and locked thereat. The plug assembly can either be a male assembly or a female assembly.

By the construction and arrangement of the apparatus of the present invention, either a male plug assembly or a female plug assembly can be selectively connected to the end of an electrical cord having the bifurcated housing and associated blades. The plug assembly is pivotal relative to the housing and lockable in an adjusted position. The apparatus of the present invention is particularly useful when the male and female plug assemblies are connected to the opposite ends of an extension cord. Normally, when connecting two conventional extension cords, the cooperating ends of the extension cords are tied together to form a knot to thereby prevent the interconnected plug assemblies from separating when a force is applied to the extension cords tending to separate them. In the present invention, by pivoting and locking each of the plug assemblies in a position 90° relative to their respective housings, the interconnected plug assemblies have a tendency to provide a stronger interconnection when a pulling force is applied to the extension cords.

BRIEF DESCRIPTION OF THE DRAWINGS

FIG. 1 is a side elevational view of the apparatus of the present invention showing a male plug assembly connected to the bifurcated housing;

FIG. 2 is a top,,plan view of the apparatus shown in FIG. 1;

FIG. 3 is a bottom plan view of the apparatus shown in FIG. 1;

FIG. 4 is an end elevational view of the bifurcated housing;

FIG. 5 is an end elevational view of the male plug assembly;

FIG. 6 is a side elevational view of the apparatus of the present invention showing a female plug assembly connected to the bifurcated housing;

FIG. 7 is a top plan view of the apparatus shown in FIG. 6;

FIG. 8 is a bottom plan view of the apparatus shown in FIG. 6;

FIG. 9 is an end elevational view of the bifurcated housing;

FIG. 10 is an end elevational view of the female plug assembly;

DESCRIPTION OF THE PREFERRED EMBODIMENT

Figure 12:
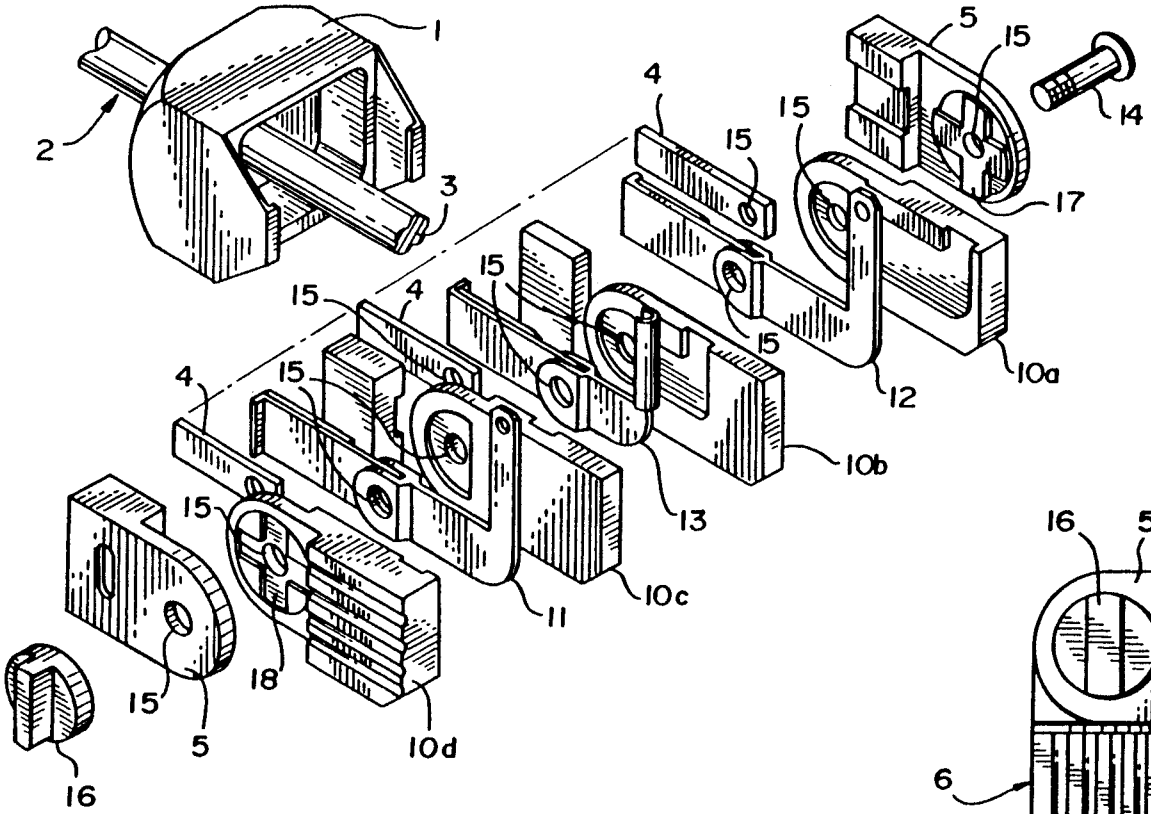
FIG. 12 is an exploded view of the bifurcated housing and the male plug assembly.

Referring to the drawings and more particularly to FIGS. 1 and 12, the multiple position electrical swivel plug apparatus of the present invention comprises a bifurcated housing 1 integrally mounted on the end of an electrical cord 2. The conductor 3, FIG. 12, of the cord terminates in a plurality of parallel, transversely spaced blades 4 positioned between the arms 5 of the bifurcated housing 1.

The plug assembly 6 comprises a body 7 having a nose portion 8 insertable between the arms 5 of the bifurcated housing 1. The nose portion 8 being slotted as at 9 to provide a plurality of parallel, transversely spaced fingers 10*a*, 10*b*, 10*c*, 10*d*. The blades 4 are insertable into the spaces between the fingers 10*a*, 10*b*, 10*c* and 10*d*, to thereby be in electrical contact with the conductors of plug assembly 6 which, as shown in FIG. 12, is a male plug assembly having electrical prongs 11, 12 and a ground 13.

The plug assembly 6 is pivotally connected to the bifurcated housing by a transverse bolt 14 extending through aligned apertures 15 provided in each of the blades 4, arms 5, fingers 10*a* to 10*d* and contacts 11, 12 and 13. A locking cap 16 is threaded onto the end of the bolt 14 to hold the plug assembly 6 in a desired angle position relative to the bifurcated housing 1. In order to lock the components in the desired position, the inner face of each arm 5 is provided with a cruciform embossment 17 received within a correspondingly shaped recess 18 formed in the opposing face of each finger 10*a* and 10*d*.

While the plug assembly shown in FIGS. 1 to 5 and 12 is a male component, FIGS. 6 to 10 and 13 shows a similar arrangement wherein a female component 19 is connected to the bifurcated housing 1 in the same manner as the male component, as described hereinabove. The blades 4 are insertable into the spaces between the fingers 10*a*, 10*b*, 10*c* and 10*d* to thereby be in electrical contact with the conductors of the female plug assembly 19 having electrical sockets 20, 21 and ground socket 22.

Figure 11:
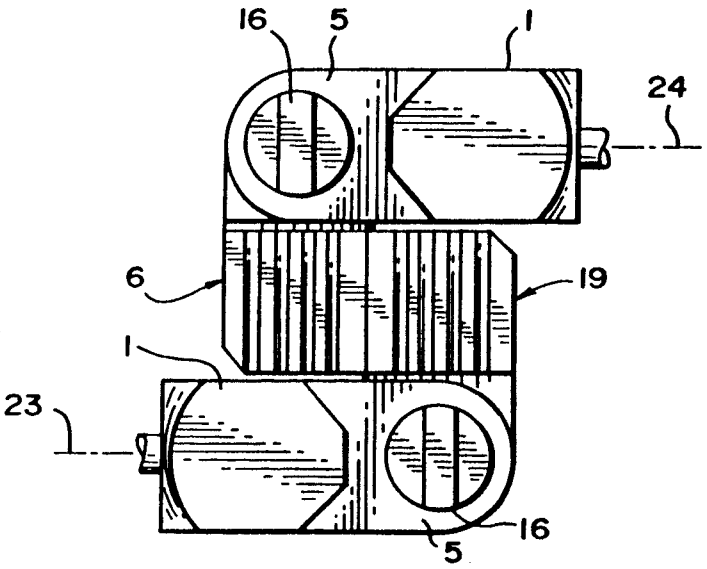
FIG. 11 is a side elevational view showing the male and female plug assemblies pivoted 90° relative to their respective bifurcated housings and interlocked thereat.
Figure 13:
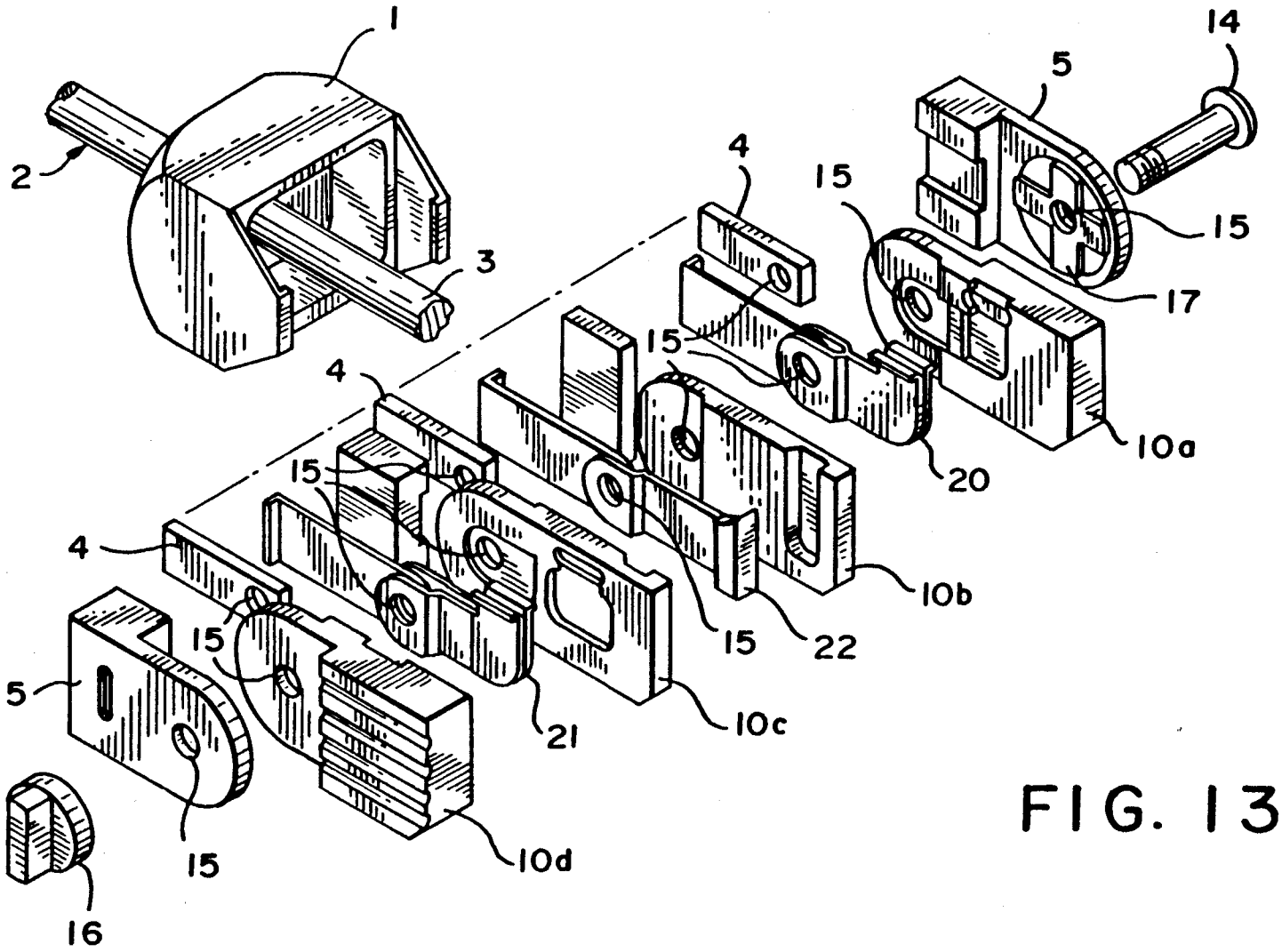
FIG. 13 is an exploded view of the bifurcated housing and the female plug assembly.

FIG. 11 illustrates the use of the swivel plug apparatus of the present invention when connecting an extension cord 23 to another electrical cord 24. In this instance, a male plug assembly 19 is connected to the end of extension cord 23, and a female plug assembly 6 is connected to the end of the other electrical cord 24. Each of the plug assemblies 6 and 19 is pivoted 90° relative to their respective bifurcated housings 1 and locked at the desired position by tightening the locking caps 16. The plug components 6 and 19 are then coupled to complete the connection, whereby any pulling force tending to separate the electrical cords 23 and 24 will push the plug components 6 and 19 toward each other to thereby make a tighter interconnection.

While FIG. 11 discloses the plug components 6 and 19 pivoted 90° relative to their respective bifurcated housings 1, it will be appreciated that the embossment 15 on each arm 5 and the cooperating recess 18 on each finger can be configured to provide various angular positions of the plug component.

It will be appreciated by those skilled in the art that the versatility of the plug components is further enhanced by providing the cord conductor 3 with the blades 4 mounted in the bifurcated housing 1. By this construction and arrangement, either a male plug 6 or a female plug 19 can be electrically connected to the bifurcated housing 1 and secured thereto by the bolt 14 and locking cap 16.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A multiple position electrical swivel plug apparatus comprising, a bifurcated housing having a pair of spaced arms, an electrical cord, said bifurcated housing being integrally mounted on an end of said electrical cord, said cord having a conductor terminating in a plurality of transversely spaced blades positioned in the space between the arms of the bifurcated housing, a plug assembly, said plug assembly having a nose portion inserted in the space between the arms of said bifurcated housing, said nose portion having a plurality of spaced fingers, said blades being inserted into the spaces between said fingers to thereby be in electrical contact with the conductors of said plug assembly, a transverse bolt extending through aligned apertures in the blades, bifurcated arms, fingers and plug assembly contacts to thereby pivotally connect the plug assembly to the bifurcated housing, and a locking cap connected to said bolt, whereby the plug assembly can be pivoted to a desired angle relative to said bifurcated housing and locked thereat.

2. A multiple position electrical swivel plug apparatus according to claim 1, wherein the plug assembly comprises a male component having electrical prongs and a ground electrically connected to the electrical cord blades.

3. A multiple position electrical swivel plug apparatus according to claim 1, wherein the plug assembly comprises a female component having electrical sockets and a ground socket electrically connected to the electrical cord blades.

4. A multiple position electrical swivel plug apparatus according to claim 1, wherein the inner face of each bifurcated arm is provided with an embossment, a correspondingly-shaped recess provided in the opposing face of the next adjacent finger, said embossment being insertable into said recess for locking the plug assembly at the desired position.

5. A multiple position electrical swivel plug apparatus according to claim 4, wherein the embossment and recess have a cruciform configuration.

* * * * *